United States Patent [19]

Rothchild

[11] 4,223,450

[45] Sep. 23, 1980

[54] METHODS AND APPARATUS FOR CONTROLLING GAS FLOWS

[75] Inventor: Ronald D. Rothchild, South Orange, N.J.

[73] Assignee: Airco, Inc., Montvale, N.J.

[21] Appl. No.: 55,226

[22] Filed: Jul. 5, 1979

[51] Int. Cl.[3] ..... F26B 3/28

[52] U.S. Cl. ..... 34/16; 34/23; 34/34; 34/36; 34/54; 34/4; 34/41; 137/93; 250/453; 427/398.4; 118/50

[58] Field of Search ..... 34/4, 41, 15, 16, 34, 34/36, 23, 242, 46, 47, 54, 155, 160; 137/93; 250/432, 453, 455, 492; 427/54, 55, 372 R, 374 R

[56] References Cited

U.S. PATENT DOCUMENTS

| | | | |
|---|---|---|---|
| 2,743,529 | 5/1956 | Hayes | 34/47 |
| 3,465,753 | 9/1969 | Levy et al. | 137/93 |
| 3,654,459 | 4/1972 | Coleman | 250/453 |
| 3,676,673 | 7/1972 | Coleman | 250/453 |
| 3,790,801 | 2/1974 | Coleman | 250/453 |
| 3,936,950 | 2/1976 | Troue | 34/41 |
| 4,118,873 | 10/1978 | Rothchild | 34/36 |
| 4,143,468 | 3/1979 | Novotny | 34/4 |
| 4,150,494 | 4/1979 | Rothchild | 34/36 |
| 4,150,670 | 4/1979 | Jewett et al. | 137/93 |

*Primary Examiner*—Larry I. Schwartz
*Attorney, Agent, or Firm*—David L. Rae; Larry R. Cassett; Edmund W. Bopp

[57] ABSTRACT

A chamber is isolated from ambient atmosphere by supplying a flow of inert gas to the entrance and/or exit of the chamber such as an oven for curing solvent borne resin coatings on a material passed therethrough. The inert gas is supplied at a substantially constant mass flow rate through an orifice which may be adjusted in opening or direction so as to enable the momentum of discharged inert gas to be controlled. A flow of gas is exhausted exteriorly of but in the vicinity of the chamber exit or entrance and the oxygen content of such flow is sensed. The sensed oxygen value is compared with a predetermined value and the difference is utilized to adjust the orifice to either increase or decrease the momentum of inert gas discharged therefrom. In this manner atmospheric oxygen is precluded from entering the chamber while only the amount (flow) of inert gas necessary to block such oxygen is utilized thereby minimizing the loss of inert gas from the chamber to ambient.

7 Claims, 2 Drawing Figures

METHODS AND APPARATUS FOR CONTROLLING GAS FLOWS

BACKGROUND OF THE INVENTION

The present invention relates to methods and apparatus for controlling gas flows and more particularly, to methods and apparatus for controlling the flow of inert gas to the entrance and/or exit of a chamber which is to be isolated from ambient atmosphere.

It is frequently necessary to treat materials under inert, non-oxidizing atmospheres. In certain treatment processes, for example the curing of solvent borne resin coatings on materials (as illustrated in U.S. Pat. No. 4,150,494 assigned to the assignee of the present invention), such coatings are cured by evaporating solvent in a curing oven. By maintaining an essentially non-oxidizing or inert condition therein, relatively high solvent vapor partial pressures may be safely obtained which facilitates the recovery of such solvent vapors. In order to enable the continuous passage of materials bearing such coatings through a curing oven, appropriate entrance and exit structures such as vestibules or gas curtains are frequently provided. Although such vestibules must be inerted, there is an unavoidable loss of inert gas from the oven to ambient atmosphere in order to preclude the entry of atmospheric or ambient oxygen therein. Inert gas may be supplied to an entrance and an exit vestibule and be removed from the curing oven together with solvent vapor. A mass balance between the supplied inert gas on the one hand and the inert gas leaving the vestibules and curing oven on the other hand will be established. However, it has been found that due to transient ambient air currents or changes in drag forces caused by passage of different coating bearing items through the oven, ambient air may enter and leave the oven notwithstanding maintenance of an inert gas mass balance. Thus, in order to assure exclusion of ambient air (oxygen) from such ovens, structure for monitoring oven conditions must be provided.

As described in U.S. Pat. No. 4,150,494, it is known to monitor pressures in an oven vestibule and control the flow of inert gas thereto in response to such pressures. Thus, should the pressure in a vestibule decrease, the flow of inert gas thereto is increased thereby essentially precluding a flow or diffusion of ambient oxygen into such vestibule. It has been found, however, that the use of pressure transducers in curing ovens is not always reliable and frequently, excessive flows of inert gas have been utilized to assure that enough inert gas is available in or at an oven entrance and exit to preclude entry of ambient oxygen. Such excessive inert gas flows, however, clearly reduce the economic attractiveness of solvent recovery systems.

In equipment adapted to enable radiation curing of coatings on a material passed through an appropriate curing chamber, it has been proposed (U.S. Pat. No. 4,118,873 which is also assigned to the assignee of the present invention) to discharge inert gas flows into such curing chamber with a momentum selected such that internal drag forces are substantially balanced thereby reducing the flow and diffusion of ambient oxygen into such curing chambers. It has been found that by balancing drag forces, coatings on materials passed through the chamber may be cured even though these materials are passed through such chambers at speeds of 1000 ft/min or greater. At such relatively high speeds, significant drag forces are developed and consequently, a momentum balance is helpful in avoiding the loss of excessive flows of inert gas.

Consequently, a clear need exists for an active and reliable technique for controlling the supply of inert gas to a chamber such that the entry of atmospheric oxygen is substantially precluded without the use of excessive and unnecessarily large inert gas flows.

OBJECTS OF THE INVENTION

It is an object of the present invention to provide improved methods and apparatus for controlling the flow of inert gas to a chamber having openings in communication with the ambient atmosphere.

It is a further object of the present invention to provide an active control over a flow of inert gas supplied to a chamber.

It is yet another object of the present invention to provide improved methods and apparatus for inerting a chamber while preventing the ingress of ambient oxygen without the use of excessive inert gas flows.

It is a further object of the present invention to provide improved methods and apparatus for inerting a chamber without requiring the placement of transducers therein.

Other objects of the present invention will become apparent from the following description of exemplary embodiments thereof which follows and the novel features will be particularly pointed out in conjunction with the claims appended hereto.

SUMMARY

In accordance with the invention, ambient oxygen is substantially precluded from entering a chamber which is inerted by supplying a flow of inert gas at a substantially constant mass flow rate to the vicinity of the chamber exit or entrance in communication with ambient, exhausting a gas stream immediately exteriorly of said entrance or exit at a predetermined flow rate with the exhausted flow including inert gas leaving the oven and ambient air, sensing the oxygen concentration of said exhausted gas stream and controlling the momentum of the inert gas stream supplied to said entrance or exit in response to said sensed oxygen concentration so that ambient oxygen is substantially precluded from entering the chamber without excessive losses of inert gas therefrom. Inert gas may be supplied to an entrance or exit vestibule of a chamber being inerted or a curtain of inert gas may be established at an interface between the chamber and ambient atmosphere. The inert gas supplied to the chamber vestibule or to the gas curtain is divided such that a portion is caused to flow into the chamber and the remainder flows outwardly to preclude the entry of ambient oxygen. In essence, the present invention enables an active and reliable control over an inert gas flow utilized to preclude the entry of ambient oxygen into a chamber and thus, losses of inert gas from the chamber are essentially limited to the level necessary to preclude entry of ambient oxygen.

In accordance with the invention, an orifice having a variable opening may be utilized to enable the supply of inert gas into a chamber vestibule or at an inert gas curtain. Alternatively, an orifice having a fixed opening but which may be directionally adjusted may be utilized such that upon altering the opening of the former discharge device of the direction of the latter, the momentum of inert gas portion utilized to counteract the gaseous boundary layer on the material translated through the chamber is adjusted to vary the inert gas discharged from the chamber exit or entrance. A stream of gas is exhausted from a location exterior to the chamber or vestibule but in the vicinity of the interface of the chamber or vestibule and the ambient atmosphere. This stream is comprised of ambient atmosphere (air) and inert gas discharged from the oven entrance or exit and is utilized to enable the oxygen content thereof to be measured. This measured oxygen level is compared with a predetermined oxygen level, e.g. 17% and the difference therebetween is utilized to either adjust the opening of the inert gas orifice or the directionality thereof as mentioned previously. In this manner, the momentum and hence quantity of inert gas (of a constant mass flow) is utilized to preclude the entry of ambient oxygen into the chamber without losses of excessive quantities of inert gas from the chamber.

BRIEF DESCRIPTION OF THE DRAWING

The invention will be more clearly understood by reference to the following description of exemplary embodiments thereof in conunction with the following drawings in which.

DESCRIPTION OF PREFERRED EMBODIMENT

Figure 1:
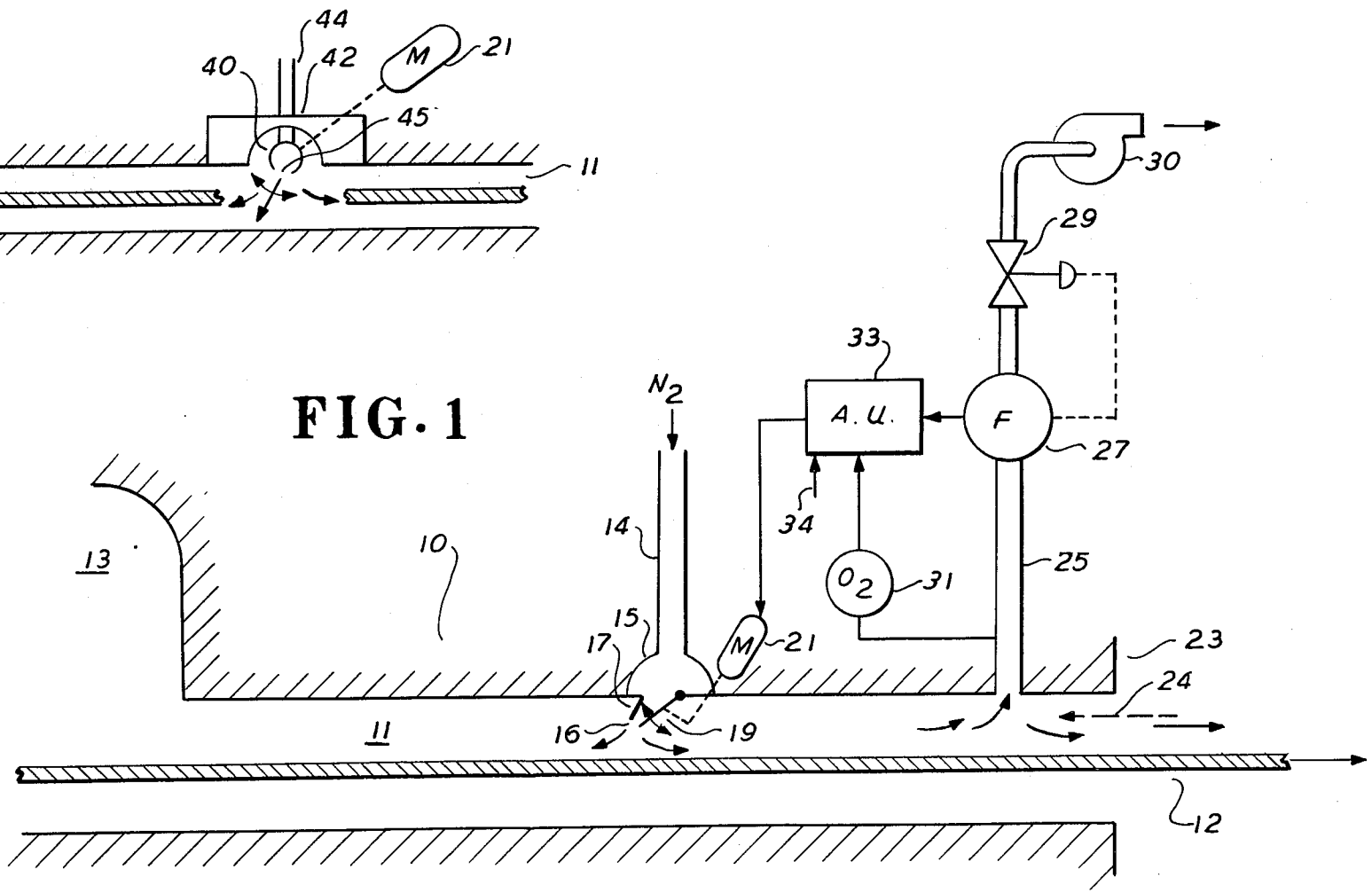
FIG. 1 is a diagrammatic view of an ambient gas flow control system for use in connection with a vestibule of a chamber being inerted.

Referring now to FIG. 1, illustrated therein is an exemplary embodiment of apparatus for precluding the entry of ambient oxygen into a chamber 13. A passage 11 is disposed between chamber 13 and the ambient atmosphere. A material 12, which may comprise a flexible, substantially planar, web material such as paper or the like or a strip of metallic material bearing a solvent borne resin coating or conveyor carrying coated articles is translated through chamber 13 and passage 11 by suitable drive means (not shown). Chamber 13 may comprise a curing oven in which solvent is evaporated from the coating as the latter is cured and passage 11 may essentially comprise a vestibule or other defined space utilized to essentially isolate chamber 13 from ambient atmosphere. A typical arrangement of a curing oven having entrance and exit vestibules is illustrated in U.S. Pat. No. 4,150,494.

In order to substantially preclude the entry of ambient oxygen into chamber 13 and to inert the same, a flow of inert gas such as nitrogen, argon, $CO_2$, etc. is supplied through conduit 14 and space 15 to an orifice 17. Nitrogen is preferred for use as an inert gas in accordance with the present invention. A substantially constant mass flow of inert gas is supplied to orifice 17 which includes a movable member 19 the adjustment of which establishes a particular aperture or opening 16. It will be understood that as a consequence of supplying a substantially constant mass flow of inert gas to orifice 17, the momentum of such flow discharged through opening 16 will be inversely related to the extent of such opening. The discharged inert gas will flow toward chamber 13 and outwardly of passage 11 toward the interface thereof with ambient atmosphere and will substantially inert passage 11 by precluding the entry of atmospheric oxygen therein. Passage 11 and orifice 16 are disposed on the exit side of chamber 13 in relation to the direction of travel of material 12. Chamber 13 is also provided with a similar entrance passage and orifice, etc. (not shown), although this latter orifice will be disposed at a similar angle to that of orifice 17, i.e., the discharged inert gas stream will be directed with a component opposed to the direction of translation of material 12 as will be discussed in greater detail hereinafter.

A conduit 25 is positioned externally of but in the vicinity of the interface of passage 11 with ambient atmosphere. A blower 30 or other means for exhausting or removing a flow of gas from passage 11 is provided with the flow rate of such removed gas being established by setting of flow meter 27 and control valve 29. Essentially, gas is withdrawn through conduit 25 at a location exteriorly of passage 11 but in the vicinity of the interface of passage 11 and ambient atmosphere at a predetermined flow rate. An oxygen sensing device 31 which may take the form of conventional apparatus effective to provide an electrical output signal representative of the oxygen content of a gas flow is disposed so as to detect the oxygen content of gas removed through conduit 25. The electrical output of sensing device 31 is supplied to arithmetic unit 33 together with an indication of the total flow rate of gas removed through conduit 25. A motor 21 is coupled to arithmetic unit 33 and is controlled thereby to actuate movable member 19 of orifice 17 such that the opening 16 will be controlled by the output of arithmetic unit 33 in a manner to be more fully described hereinafter.

Upon operation of the apparatus illustrated in FIG. 1, air will tend to flow and diffuse inwardly in the general direction of dotted arrow 24 and will commingle with inert gas in the region of the interface of passage 11 and ambient atmosphere. The flow of gas removed or exhausted through conduit 25 will be essentially comprised of ambient atmosphere (air) and nitrogen flowing out of and, for example, the oxygen concentration of such removed gas will typically be 15–19%. The actual oxygen content of such removed gas is detected by device 31 which in turn supplies an electrical signal representative of this oxygen content to arithmetic unit 33. An electrical signal representative of a predetermined or reference oxygen concentration to be maintained in the removed stream is supplied in known manner through line 34 to arithmetic unit 33 which is effective to compare the actual and predetermined or desired oxygen content and supply an output signal representative of the difference therebetween to motor 21 which is effective to adjust the position of movable member 19 of orifice 17. In this manner, transient currents of ambient air or altered internal drag forces in oven 10 will be reconciled as the resulting changes in the oxygen concentration of gas exhausted through conduit 25 will result in the momentum of the inert gas supplied to orifice 17 to be changed accordingly.

As material 12 is translated through chamber 13 which typically contains a non-oxidizing atmosphere comprised of inert gas (nitrogen) and solvent vapor, etc., frictional forces between material 12 and such atmosphere develop a gas boundary layer low in oxygen. In fact, the boundary layer immediately adjacent material 12 is essentially comprised of inert gas which is discharged from orifice 17 in a direction having a component parallel to the plane of and opposed to the direction of translation of material 12. The momentum of the inert gas flow emitted from orifice 17 will interfere with the gas boundary layer of material 12 and will tend to restrain or preclude this gas boundary layer from being dragged out of passage 11. As this gas boundary layer is essentially comprised of inert gas (and/or evaporating solvent vapor), the more interference between the inert gas flow discharged from orifice 17 and the gas boundary layer, the greater is the degree of inerting of chamber 13 and passage 11. Thus, by controlling the momentum of the nitrogen flow discharged from orifice 17, the degree of 'interference' and extent to which inert conditions are maintained in chamber 13 and passage 11 are also controlled.

As mentioned previously, nitrogen is supplied at a substantially constant mass flow rate through conduit 14 and orifice 17. By adjusting the opening of orifice 17, the velocity and hence momentum of this nitrogen flow will be varied. Thus, the extent to which nitrogen is restrained, i.e. inert conditions are maintained in chamber 13 and passage 11, will be controlled by the extent of the opening of orifice 11 which in turn is controlled by the oxygen concentration detected in the gas exhausted through conduit 25. In the event that the sensed oxygen content of the removed gas stream in conduit 25 is greater than a predetermined value, i.e. the flow or diffusion of ambient oxygen inwardly of passage 11 is greater than desired, member 19 is adjusted to a more open position thereby decreasing the velocity and momentum (but not the total flow) of inert gas discharged through orifice 17. This decreased momentum results in less interference with the gas boundary layer attached to material 12 and consequently, more inert gas comprising this boundary layer is dragged outwardly from passage 11. The nitrogen content of the gas immediately outside the interface of passage 11 and ambient atmosphere is increased which results in a reduced oxygen content of the gas removed through conduit 25 until this oxygen content approaches the predetermined oxygen content (e.g. 17%).

In the event the oxygen content of the gas removed through conduit 25 is below a predetermined value, excessive inert gas is being discharged from passage 11 to the ambient atmosphere (as a consequence of the boundary layer and flow from orifice 17) and consequently economics of the apparatus for inerting passage 11 and chamber 13 are adversely affected. Thus, as described previously, movable member 19 of orifice 17 is adjusted to a more closed position such that the momentum of the inert gas flow discharged from orifice 17 is increased thereby interfering with the boundary layer of material 12 to a greater extent and restraining more inert gas in chamber 13 and passage 11. Thus, less gas is dragged out of passage 11 and less inert gas is lost to ambient. This, of course, will result in a greater oxygen concentration of the gas removed through conduit 25 and by selecting a predetermined, desired oxygen content of such removed gas, the loss of inert gas to ambient may be minimized while yet assuring that passage 11 and chamber 13 are effectively inerted.

Figure 2:
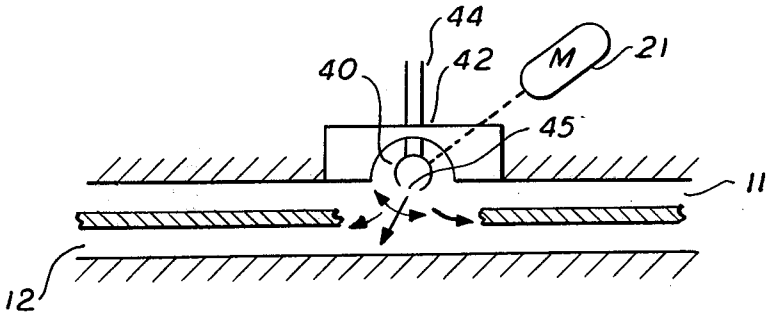
FIG. 2 is a diagrammatic view of an alternate device for discharging inert gas to inert a chamber and prevent the entry of ambient oxygen therein.

It will be understood that adjustment of movable member 19 of orifice 17 is effective to enable the momentum of inert gas discharged therethrough to be controlled. However, it is the horizontal component or the component of momentum parallel to the plane of material 12 which is effective in interfering with the gas boundary layer of material 12. Accordingly, it is within the scope of the present invention to utilize other gas discharge devices which enable a control over such horizontal components of the momentum of an inert gas stream. Referring now to FIG. 2, illustrated therein is a further embodiment of the present invention wherein material 12 which typically bears a solvent borne resin coating is translated or passed through passage 11. A conduit 40 which preferably extends transversely across such passage is provided with a gap or opening 45 therein which also extends essentially completely transversely across passage 11. A suitable conduit 44 is utilized to supply inert gas at a predetermined constant mass flow rate to conduit 40 which is preferably mounted for rotation about the longitudinal axis thereof in a suitable support means 42. Accordingly, by adjusting the angular position of aperture 45 by rotating conduit 40 to an extent controlled by the arithmetic unit 33 as previously described in connection with operation of motor 21 of apparatus 10 illustrated in FIG. 1. Rotation of conduit 40 will alter the horizontal component of the momentum of the inert gas flow discharged through opening 45 and thus control the extent to which this inert gas flow interferes with the gas boundary layer of material 12. Thus, by altering the horizontal component of momentum of inert gas flow discharged through opening 45, the oxygen concentration of gas removed from a location external to the passage being inerted may be controlled so that such inerting may be effected by an "active" control but without excessive losses of inert gas to atmosphere.

It will be understood that conduit 25 may be located exteriorly of the interface 23 of passage 11 with respect to ambient atmosphere. Also, conduit 14 and orifice 17, etc. may be disposed exteriorly of interface 23 in the event it is desired to establish an external gas curtain to preclude entry of atmospheric oxygen into passage 11. However, regardless of the specific location of conduits 14 and 25, etc., the control of the orifice through which inert gas is discharged will be as described heretofore with reference to the structure illustrated in FIGS. 1 and 2. Although chamber 13 and passage 11 have been described in relation to systems for curing solvent borne resin coatings, it will be understood that the present invention is suitable for use in connection with inerting any particular passage or space which has two or more openings in communication with ambient atmosphere.

The foregoing and other various changes in form and details may be made without departing from the spirit and scope of the present invention. Consequently, it is intended that the appended claims be interpreted as including all such changes and modifications.

What is claimed is:

1. A method of inerting a passage having at least two interfaces in communication with ambient atmosphere comprising the steps of supplying inert gas at a substantially constant mass flow rate to said passage with a portion of said inert gas flow being directed to at least one of said interfaces; removing an exhaust gas flow at a predetermined flow rate from a location in the vicinity of said interface with said exhaust flow including inert gas discharged from the chamber and ambient atmosphere; sensing the oxygen content of said exhaust gas flow; comprising the sensed oxygen content with a predetermined oxygen content; and controlling the momentum of said inert gas flow into said passage in response to said comparison of sensed and predetermined oxygen contents to maintain said predetermined oxygen content in said exhaust gas flow with minimal loss of inert gas from said passage to ambient atmosphere.

2. The method defined in claim 1 additionally comprising the step of passing a substantially planar material through said passage and wherein the step of controlling momentum comprises regulating the component of the momentum of said inert gas flow parallel to said planar material in the opposite direction of travel of said material whereby the degree to which said component interferes with a gas boundary layer on said material is controlled.

3. The method defined in claim 2 wherein the step of supplying said inert gas flow comprises discharging said inert gas flow through an orifice having a variable opening into contact with said material.

4. The method defined in claim 1 wherein said step of supplying said inert gas flow comprises discharging said inert gas flow through an orifice having a variable opening.

5. The method defined in claim 1 wherein the step of supplying said inert gas flow comprises discharging said inert gas flow through an orifice having a fixed opening, the directionality of which may be adjusted.

6. The method defined in claim 4 wherein said step of controlling momentum further comprises adjusting the opening of said orifice in response to said sensed oxygen content.

7. The method defined in claim 5 wherein said step of controlling momentum further comprises adjusting the directionality of said orifice in response to said sensed oxygen content.

* * * * *

UNITED STATES PATENT AND TRADEMARK OFFICE

CERTIFICATE OF CORRECTION

PATENT NO. : 4,223,450

DATED : September 23, 1980

INVENTOR(S) : RONALD D. ROTHCHILD

It is certified that error appears in the above-identified patent and that said Letters Patent are hereby corrected as shown below:

Column 2, line 66, "of" first occurrence should read --or--.

Column 3, line 24, "ambient" should read --inert--.

Column 5, line 49, the word --inert-- is missing from before "gas", second occurrence.

Column 6, line 56 (Claim 1) "the" should read --said--;

line 58 (Claim 1) "comprising" should read --comparing--.

Signed and Sealed this

Sixth Day of January 1981

[SEAL]

*Attest:*

SIDNEY A. DIAMOND

*Attesting Officer*

*Commissioner of Patents and Trademarks*